US008155568B2

(12) United States Patent
Naito et al.

(10) Patent No.: US 8,155,568 B2
(45) Date of Patent: Apr. 10, 2012

(54) TONER CONTAINER, PRODUCTION METHOD FOR TONER PRODUCT AND TONER REPLENISHING METHOD

(75) Inventors: Kiyotaka Naito, Tokyo (JP); Yoshihiko Toyoizumi, Tokyo (JP); Tatsuo Nakanishi, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 399 days.

(21) Appl. No.: 12/433,947

(22) Filed: May 1, 2009

(65) Prior Publication Data

US 2009/0279921 A1 Nov. 12, 2009

(30) Foreign Application Priority Data

May 7, 2008 (JP) ..... 2008-121023

(51) Int. Cl.
*G03G 15/08* (2006.01)

(52) U.S. Cl. ..... 399/262

(58) Field of Classification Search ..... 399/119, 399/120, 258, 262, 263
See application file for complete search history.

(56) References Cited

U.S. PATENT DOCUMENTS

| | | | | |
|---|---|---|---|---|
| 5,918,095 | A * | 6/1999 | Huang | 399/263 |
| 6,671,482 | B2 * | 12/2003 | Dilanni et al. | 399/262 |
| 2006/0034642 | A1 * | 2/2006 | Taguchi et al. | 399/258 |
| 2007/0154243 | A1 * | 7/2007 | Taguchi et al. | 399/258 |

FOREIGN PATENT DOCUMENTS

| | | |
|---|---|---|
| JP | 2006071762 | 3/2006 |
| JP | 3868146 | 10/2006 |

* cited by examiner

*Primary Examiner* — Sandra Brase
(74) *Attorney, Agent, or Firm* — Lucas & Mercanti, LLP

(57) ABSTRACT

A toner container for replenishing toner to an image forming apparatus, including: a container main body having a toner outlet and a toner conveyance device which conveys the toner toward the toner outlet through rotation; a cap which covers the toner outlet and has a toner ejecting section; a toner ejecting member which conveys the toner from the container main body to the cap; and a holding ring which is fixed with the toner ejecting member, wherein the container main body has a first engagement member which engages with an engagement section of the holding ring such that the container main body, rotates together with the holding ring and the toner ejecting member, and wherein the cap has a second engagement member which engages with the holding ring such that the holding ring and the toner ejecting member are rotatable.

7 Claims, 4 Drawing Sheets

TONER CONTAINER, PRODUCTION METHOD FOR TONER PRODUCT AND TONER REPLENISHING METHOD

CROSS REFERENCE TO RELATED APPLICATION

The present application is based on Japanese Patent Application No. 2008-121023 filed with Japanese Patent Office on May 7, 2008, the entire content of which is hereby incorporated by reference.

BACKGROUND OF THE INVENTION

1. Technical Field

The present invention relates to an improvement of a toner container.

2. Description of Prior Art

In the image forming apparatus of an electrophotographic mode, there is widely employed a toner replenishing method wherein a toner container storing toner is installed in the image forming apparatus, and toner is supplied bit by bit to the image forming apparatus from the toner container in the course of operations of the image forming apparatus.

A toner container used in the toner replenishing method of this kind is figured out so that a toner outlet of the toner container may be opened automatically when the toner container is in an image forming apparatus, and the toner outlet may be closed automatically when the toner container is taken out of the image forming apparatus.

The toner container of this kind is composed of a container main body that stores toner and of a cap that covers a toner outlet of the container main body, and when the toner container is installed in the image forming apparatus, toner is supplied to the image forming apparatus from the container main body through the cap.

With respect to the toner container of this kind, each of Japanese Registration Patent No. 3868146 (Patent Document 1) and Unexamined Japanese Patent Application Publication No. 2006-71762 (Patent Document 2) discloses one wherein an ejecting fin, or an agitating member is provided in the vicinity of an outlet of the container main body for preventing that a portion of the toner outlet of the container main body is clogged with toner.

The toner container is required not to leak toner when the toner container is conveyed with toner stored in the toner container and when the toner replenishment is in execution under the condition that the toner container is installed in the image forming apparatus.

Each of the ejecting fin in Patent Document 1 and the agitating member in Patent Document 2 is provided on the container main body.

A toner outlet on the container main body is used also as a toner accepting inlet through which the toner is introduced when toner is filled.

In the case of the toner containers in Patent Document 1 and Patent Document 2, each of the ejecting fin and the agitating member is in the structure to close a part of the toner accepting inlet to be an obstacle in the toner filling process, which causes problems that toner scattering occurs in the course of toner filling and the toner filling takes a long time.

As a measure for the aforesaid problems, it is possible to employ a method wherein toner is filled in a container main body having neither ejecting fin nor agitating member, then, the ejecting fin or the agitating member is installed and a cap is mounted finally. However, this method has problems that processes are complicated, and comingling of foreign substances as well as toner scattering tend to be caused.

Objectives of the invention is to solve the aforesaid problems in a conventional toner container, and to provide a toner container which can prevent toner scattering and comingling of foreign substances in production process to fill toner in the toner container and to seal with a cap, a method for producing toner product by filling toner in the toner container, and a toner replenishing method to replenish toner to an image forming apparatus from the toner container.

SUMMARY

A toner container reflecting one aspect of the present invention to solve the above mentioned problem is the toner container for replenishing toner to an image forming apparatus, including: a container main body having a toner outlet and a toner conveyance device which conveys the toner toward the toner outlet through rotation; a cap which covers the toner outlet and has a toner ejecting section; a toner ejecting member which conveys the toner from the container main body to the cap; and a holding-ring which is fixed with the toner ejecting member, wherein the container main body has a first engagement member which engages with an engagement section of the holding ring such that the container main body, rotates together with the holding ring and the toner ejecting member, and wherein the cap has a second engagement member which engages with the holding ring such that the holding ring and the toner ejecting member are rotatable.

A method of producing a toner product, reflecting another aspect of the present invention includes: a toner filling step to fill toner in a container main body having a toner outlet; a cap assembling step to make the cap having a toner-ejecting section rotatably hold a toner ejecting member and a holding ring which holds the toner ejecting member; and a cap attaching step to cover the toner outlet with the cap by connecting the toner container main body filled with the toner with the cap assembled with the toner ejecting member and the holding ring.

A toner replenishing method reflecting another aspect of the invention includes the steps of: fixing the cap of the toner container described above; and rotating the toner container main body and the toner ejecting member to replenish the toner from the toner container into the image forming apparatus.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

The invention will be explained as follows based on the embodiment, to which, however, the invention is not limited.

Figure 1:
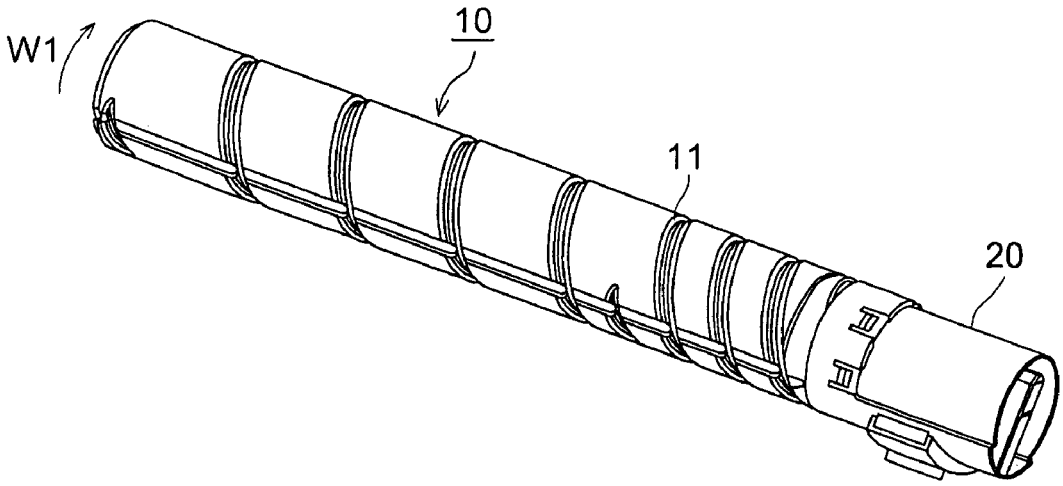
FIGS. 1(*a*) and 1(*b*) respectively show an appearance perspective view and a side elevation of a toner container relating to the embodiment of the invention.
Figure 1:
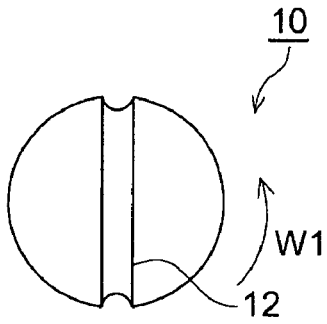
Figure 2:
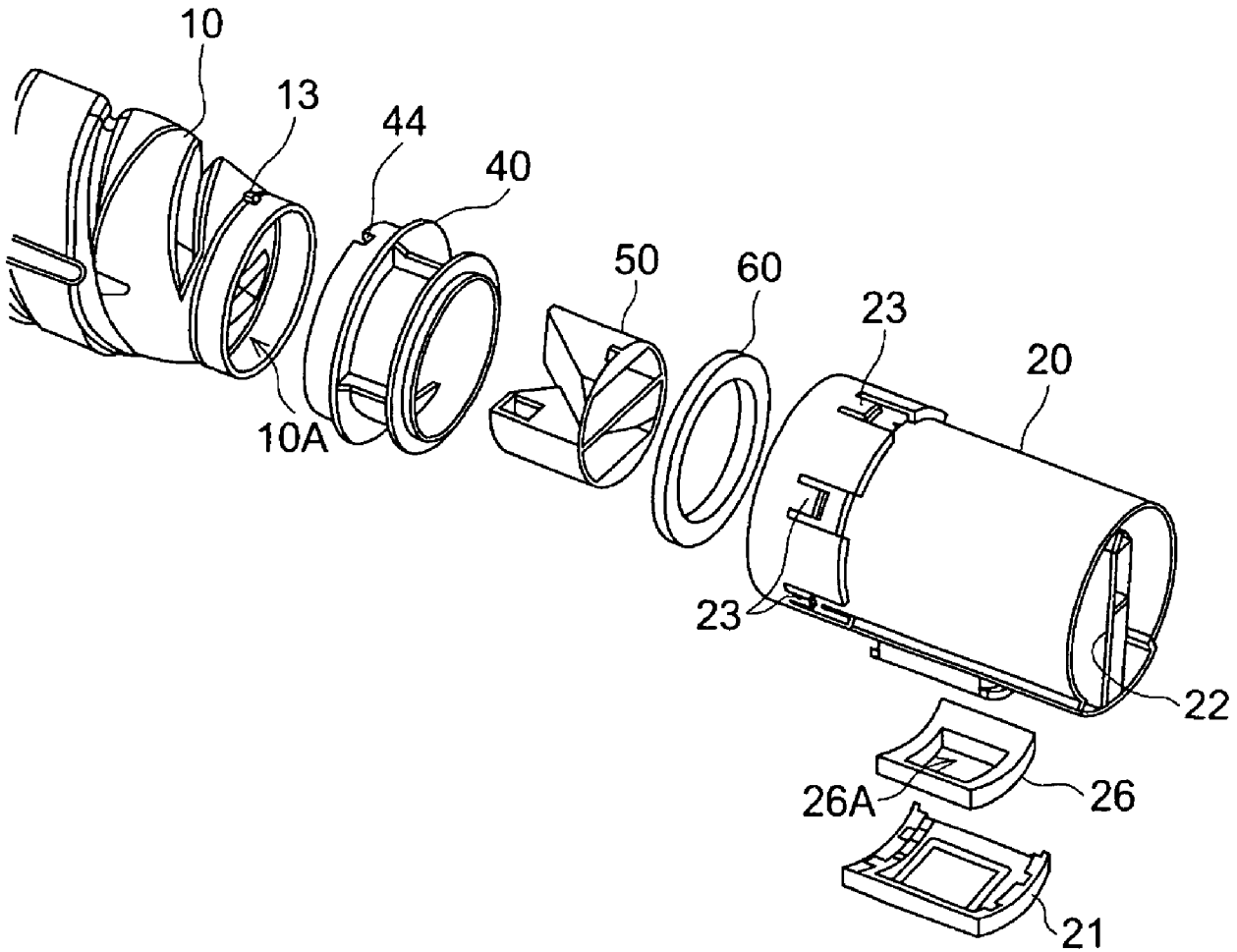
FIG. 2 is an exploded perspective view of a toner container shown in FIGS. 1(*a*) and 1(*b*)

FIGS. 1(*a*) and 1(*b*) respectively show an appearance perspective view and a side elevation of a toner container relating to the embodiment of the invention, and FIG. 2 is an exploded perspective view of a toner container shown in FIGS. 1(*a*), (*b*).

A toner container has cylindrical container main body 10, cap 20, holding ring 40, toner ejecting member 50 and seal member 60.

The toner container is loaded in an image forming apparatus (not shown), and when toner is replenished, the toner container is rotated around the axis of the cylinder as shown with arrow W1, thereby, toner in container main body 10 is sent toward cap 20 by propulsion actions of spiral projection 11 (toner conveyance member) caused by the rotation, then, is conveyed from toner outlet 10A to cap 20 and is ejected from an ejecting section (which will be explained later) provided on the cap 20.

For the purpose of lowering production cost, it is preferable to make container main body 10 through blow molding.

A rotation of toner container main body 10 shown with arrow W1 is carried out by a drive member (not shown) on the image forming apparatus side that is engaged with groove 12 shown in FIG. 1 (*b*).

Incidentally, although projection 11 and groove 12 are formed to be in a shape of a groove as an appearance of toner container 10, the projection 11 functions as a projection representing a conveyance member that conveys toner on the inside of container main body 10, while, the groove 12 functions as a groove to accept a drive member.

Parts to be rotated in the case of toner replenishment include container main body 10, holding ring 40, toner ejecting member 50 and seal member 60, and cap does not rotate. Meanwhile, though seal member 60 adheres to holding ring 40 to be fixed thereon, it is also possible to cause seal member 60 to be fixed on cap 20 to serve as a static member.

Figure 3:
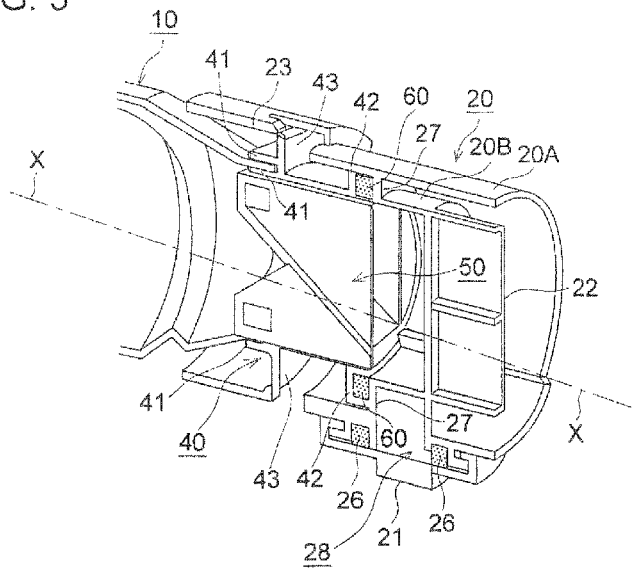
FIG. 3 is a cross-sectional view on a plane passing through rotation center X of the toner container.

FIG. 3 is a cross-sectional view on a plane passing through rotation axis X of a toner container constituted with cap 20 and container main body 10 wherein the cap 20 is installed on the container main body 10.

The cap 20 is in a complicated form as is illustrated, and it is preferable to make the cap 20 through injection molding for forming this complicated form accurately.

It is preferable to make up also holding ring 40 and toner ejecting member 50 through injection molding equally.

The holding ring 40 and the toner ejecting member 50 control the toner that is pushed out from container main body 10 when container main body 10 is rotated and is conveyed in the direction of rotation axis, and the holding ring 40 and the toner ejecting member 50 construct a toner ejecting device that averages a rate of toner ejected from cap 20.

The toner ejecting member 50 is fixed on container main body 10 when the toner ejecting member 50 is press fitted into the holding ring 40. Incidentally, the toner ejecting member 50 has only to be fixed on the holding ring 40, and it is also possible to fix both the holding ring 40 and the toner ejecting member 50 with adhesive agents after fitting the toner ejecting member 50 into the holding ring 40.

The cap 20 is composed of a large diameter section closer to container main body 10 and a small diameter section on the toner ejection side.

On the small diameter section, there are provided shutter 21 and knob 22 operated by an operator, and on the large diameter section, there is provided engagement claw 23 that holds the holding ring 40.

As shown in FIG. 2, a plurality of engagement claws 23 are provided on the circumference to hold the holding ring 40 with elastic actions of plastic so that the holding ring 40 may not slip out in the X direction, and the engagement claws 23 engage with the holding ring 40 in a way that the holding ring 40 may rotate freely in the direction of arrow W1.

The holding ring 40 is held on cap 20 in a rotatable manner by engagement claw 23 representing the second engagement member.

The cap 20 is formed to be of a dual structure for cylinder 20A and cylinder 20B, on its toner ejection side, and the cylinder 20A is connected to the cylinder 20B by brim 27.

The cap 20 further has shutter 21, and the shutter 21 is provided to be rotatable for cylinder 20A.

Seal member 26 is interposed between the cylinder 20A and the shutter 21 to prevent toner leakage. The seal member 26 has opening 26A and is square, and it forms an outlet for toner ejected from toner ejecting section 28.

In the case of toner replenishment, seal member 60 rotates together with holding ring 40, and a space between brim 27 and brim 42 is formed to be of a highly accurate fixed value because each item is formed through injection molding, and fluctuations in the case of rotation are less. Therefore, high sealing nature can be maintained, and toner leakage can be prevented for a long time.

Holding ring 40 has brim 43 on the container main body side, and brim 42 on the toner ejection side.

On the container main body side of holding ring 40, there is further provided double-fork-shaped holding section 41.

The tip of container main body 10 on the toner ejection side is pressed into the holding ring 41.

As shown in FIG. 2, projection 13 for positioning is formed on container main body 10, groove 44 for positioning is formed on the holding ring 40 and projection 13 is fit in groove 44, when container main body 10 is pressed into holding section 41 of holding ring 40. The projection 13 constitutes the first engagement member that causes holding ring 40 to rotate together with a container main body, and container main body 10 and holding ring 40 are combined by projection 13 and groove 44 so that the container main body 10 and the holding ring 40 may be rotated together.

As stated above, when container main body 10 is rotated in the direction of W1 in FIG. 1 (*a*), holding ring 40 and toner ejecting member 50 rotate integrally. The holding ring 40 and the toner ejecting member 50 constitute a toner ejection device that controls a flow of toner ejected toward cap 20 form container main body 10, and toner is ejected at an averaged rate from toner ejecting section 28 of cap 20, by the toner ejection device.

Seal member 60 is interposed between brim 42 formed on the toner ejection side of holding ring 40 and brim 27 formed on cap 20 under the compressed state, and prevents that toner leaks out of the gap between the cap 20 and holding ring 40.

Figure 4:
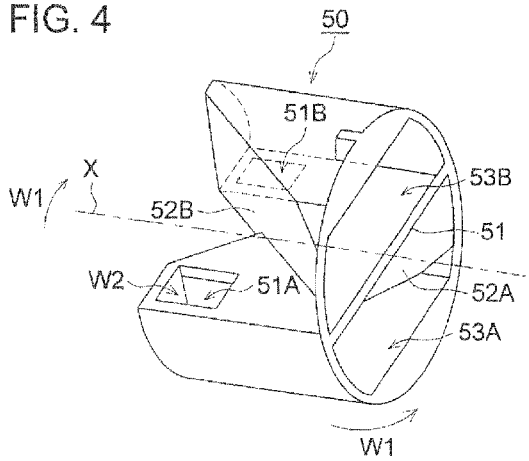
FIG. 4 is a perspective view of toner ejecting member 50.
Figure 5:
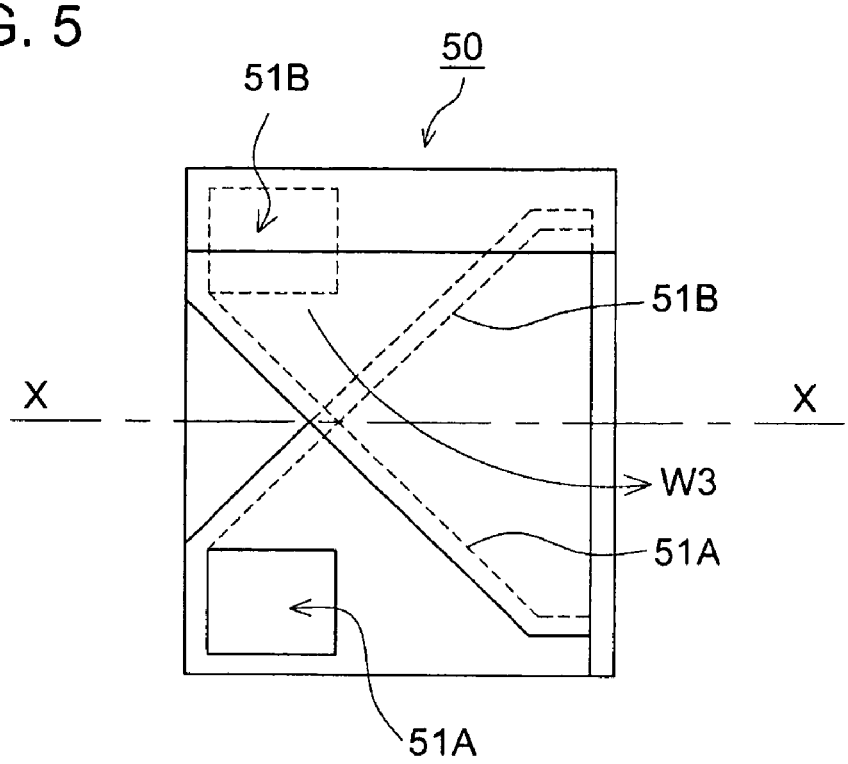
FIG. 5 is a cross-sectional view on a plane passing through axis of rotation X of toner ejecting member 50.

FIG. 4 is a perspective view of toner ejecting member 50, and FIG. 5 is a cross-sectional view on a plane passing through axis of rotation X of toner ejecting member 50.

On the toner ejecting member 50, there are formed toner passage chambers 53A and 53B which are divided by center wall 51 formed on a plane including rotation axis X.

Though the toner passage chamber 53B is deviated from the toner passage chamber 53A by 180° in terms of a phase around the rotation axis X, they are the same in terms of a shape.

Toner entrance 51A is formed at the position near container main body 10 (see FIG. 2) of a portion of center wall 51 that forms the toner passage chamber 53A, and toner entrance 51B is formed at the position near container main body 10 of a portion of center wall 51 that forms the toner passage chamber 53B.

The toner passage chamber 53A is formed by the center wall 51, the cylindrical wall and tilted wall 52A, and the toner passage chamber 53B is formed by the center wall 51, the cylindrical wall and inclined wall 52B.

The tilted wall 52A is tilted from rotation axis X by about 45°, and tilted wall 52B is tilted in the direction opposite to that for the tilted wall 52A.

An end portion of each of the toner passage chambers 53A and 53B is opened as illustrated.

When toner ejecting member 50 is rotated in the direction of arrow W1, toner is sent in as shown by arrow W2 from a toner entrance located at a low position, for example, from 51A, and toner enters toner passage chamber 53A.

When the toner ejecting member 50 continues rotating, toner that has been located at the lower position is displaced upward to the higher position, and an angle of a tilt of tilted wall 52A turns out to be opposite to that in the case of toner introduction.

As a result, toner in the toner passage chamber 53A slides down on tilted wall 52A in the direction of arrow W3 to be ejected out of an opening section of the toner passage chamber 53A.

The toner thus ejected out is ejected from toner ejection section 28.

This sort of toner ejection operation is carried out reciprocally for the toner passage chamber 53A and the toner passage chamber 53B, and toner is ejected continuously from a toner container by rotation of container main body 10 shown with arrow W1, thus, toner is replenished to a developing unit (which is not illustrated).

Figure 6:
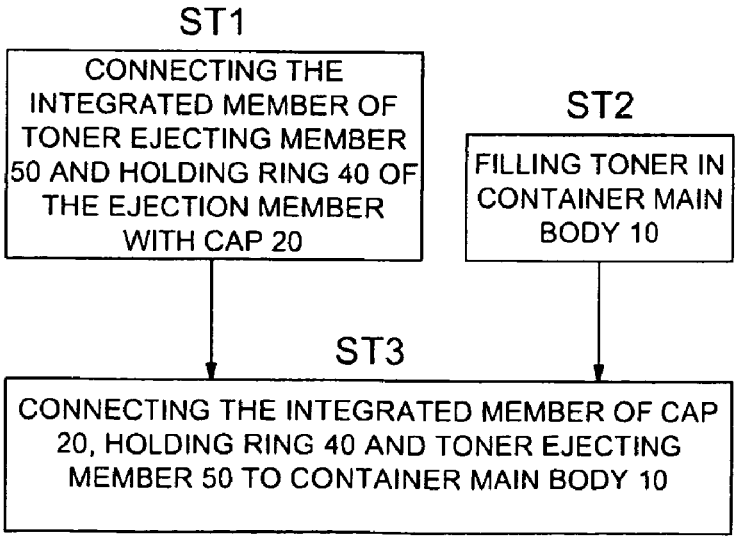
FIG. 6 is a diagram showing a production process for toner products.

A toner product wherein toner is filled in a toner container is produced through the progress shown in FIG. 6. Step ST1: An integrated member of holding ring 40 and toner ejecting member 50 is connected with cap 20. The holding ring 40 and the toner ejecting member 50 are combined to be rotatable for the cap 20. Step ST2: Toner is filled in container main body 10. Step ST3: The container main body 10 that is filled with toner is combined with an integrated member including the Cap 20, the holding ring 40 and the toner ejecting member 50.

As explained earlier, container main body 10 is combined with holding ring 40 by pressing an end portion of the container main body 10 into the holding section 41.

Meanwhile, either one of the step ST1 and the step ST2 can be carried out, or both of them can be carried out simultaneously.

Since the integrated member including the cap 20, holding ring 40 of ejection member and the toner ejecting member 50 is combined with container main body 10, after toner is filled in the container main body 10, a process of combining cap 20 with container main body 10 turns out to be one step, and it is possible to prevent sufficiently comingling of foreign substances and toner scattering in the course of production for toner products.

Though the toner ejection member is composed of holding ring 40 and the toner ejection member 50 in the embodiment explained above, it is also possible to constitute with a single part instead of the aforesaid items.

In the invention, it is possible to produce toner products by attaching the subassembly, where a toner ejection member is combined with a cap, on the container main body filled with toner.

Therefore, it is possible to prevent sufficiently toner scattering and comingling of foreign substances which are caused when toner is filled in the container main body.

What is claimed is:

1. A toner container for replenishing toner to an image forming apparatus, comprising:

a container main body having a toner outlet and a toner conveyance device which conveys the toner toward the toner outlet through rotation;

a cap which covers the toner outlet and has a toner ejecting section;

a toner ejecting member which conveys the toner from the container main body to the cap; and a holding ring which is fixed with the toner ejecting member to house the toner ejection member, and which is housed in the cap, wherein the container main body has a first engagement member which engages with an engagement section of the holding ring such that the container main body, rotates together with the holding ring and the toner ejecting member, wherein the cap has a second engagement member which engages with the holding ring such that the holding ring and the toner ejecting member are rotatable together with the container main body to convey the toner while the cap does not rotate, and wherein the holding ring and the toner ejection member are configured not to protrude into the container main body.

2. The toner container of claim 1, wherein the first engagement member is a projection provided on the container main body, and the engagement section of the holding ring is a groove.

3. The toner container of claim 1, wherein the toner ejecting member and the holding ring are fixed together by press fitting.

4. The toner container of claim 1, wherein the toner ejecting member and the holding ring are made in one body.

5. A toner replenishing method comprising the steps of:

fixing the cap of the toner container described in claim 1; and rotating the toner container main body and the toner ejecting member to replenish the toner from the toner container into the image forming apparatus.

6. A method of producing a toner product, comprising:

a toner filling step to fill toner in a container main body having a toner outlet;

a cap assembling step to make the cap having a toner ejecting section house a toner ejecting member and a holding ring which holds the toner ejecting member, and hold the toner ejecting member and the holding ring such that the holding ring and the toner ejecting member are rotatable together with the container main body to convey the toner while the cap does not rotate; and a cap attaching step to cover the toner outlet with the cap by connecting the toner container main body filled with the toner with the cap assembled with the toner ejecting member and the holding ring wherein the holding ring and the toner ejection member are configured not to protrude into the container main body.

7. The method of producing a toner product of claim 6, wherein in the cap attaching step, the cap is connected with the container main body such that the container main body rotates together with the holding ring and the toner ejecting member.

* * * * *